US008108217B2

(12) United States Patent
Yoo et al.

(10) Patent No.: US 8,108,217 B2
(45) Date of Patent: Jan. 31, 2012

(54) NOISE ADAPTIVE MOBILE COMMUNICATION DEVICE, AND CALL SOUND SYNTHESIZING METHOD USING THE SAME

(75) Inventors: Myung-Hyun Yoo, Seongnam-si (KR); Jaywoo Kim, Yongin-si (KR); Joonah Park, Seoul (KR); Seung-Nyung Chung, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1189 days.

(21) Appl. No.: 11/055,220

(22) Filed: Feb. 11, 2005

(65) Prior Publication Data

US 2005/0177366 A1 Aug. 11, 2005

(30) Foreign Application Priority Data

Feb. 11, 2004 (KR) ..... 10-2004-0008924

(51) Int. Cl.
*G10L 13/06* (2006.01)

(52) U.S. Cl. ..... 704/268; 704/226; 704/233; 704/258

(58) Field of Classification Search ..... 704/268
See application file for complete search history.

(56) References Cited

U.S. PATENT DOCUMENTS 5,465,401 A * 11/1995 Thompson ..... 455/558
5,524,148 A * 6/1996 Allen et al. ..... 379/391
5,594,803 A * 1/1997 Fujiwara et al. ..... 381/71.1
5,617,472 A * 4/1997 Yoshida et al. ..... 379/390.02
5,839,101 A * 11/1998 Vahatalo et al. ..... 704/226
5,970,446 A * 10/1999 Goldberg et al. ..... 704/233
6,377,680 B1 * 4/2002 Foladare et al. ..... 379/392.01
6,662,027 B2 * 12/2003 Chia et al. ..... 455/570
6,741,873 B1 * 5/2004 Doran et al. ..... 455/569.1
6,845,338 B1 * 1/2005 Willins et al. ..... 702/150
6,978,010 B1 * 12/2005 Short et al. ..... 379/388.03
7,031,460 B1 * 4/2006 Zheng et al. ..... 379/406.06
7,035,796 B1 * 4/2006 Zhang et al. ..... 704/226
7,283,956 B2 * 10/2007 Ashley et al. ..... 704/228
2002/0141599 A1 * 10/2002 Trajkovic et al. ..... 381/71.6
2002/0193130 A1 * 12/2002 Yang et al. ..... 455/501
2003/0003944 A1 * 1/2003 Rosenzweig ..... 455/550
2003/0007631 A1 * 1/2003 Bolognesi et al. ..... 379/387.02
2003/0103632 A1 * 6/2003 Goubran et al. ..... 381/73.1
2004/0083095 A1 * 4/2004 Ashley et al. ..... 704/219

FOREIGN PATENT DOCUMENTS

JP 2002-051108 2/2002
JP 2002-314637 10/2002

OTHER PUBLICATIONS

Korean Notice of Allowance dated Jun. 10, 2011, issued in corresponding U.S. Patent Application No. 10-2004-0008924.

* cited by examiner

*Primary Examiner* — Leonard Saint Cyr
(74) *Attorney, Agent, or Firm* — Staas & Halsey LLP

(57) ABSTRACT

A noise adaptive mobile communication device including a noise collecting microphone which collects noise from a peripheral environment; a noise sensing unit which senses the collected noise; a frequency-component detecting unit which detects a frequency component of the sensed noise; a sound generating unit which generates a noise-adaptive sound from the detected frequency component; a call-sound synthesizing unit which synthesizes received call sound with the noise-adaptive sound; and an operation control unit which controls the call-sound synthesizing unit to operate each predetermined time.

17 Claims, 7 Drawing Sheets

NOISE ADAPTIVE MOBILE COMMUNICATION DEVICE, AND CALL SOUND SYNTHESIZING METHOD USING THE SAME

CROSS-REFERENCE TO RELATED APPLICATION

This application claims the priority of Korean Patent Application No. 2004-8924, filed on Feb. 11, 2004, in the Korean Intellectual Property Office, the disclosure of which is incorporated herein in its entirety by reference.

BACKGROUND OF THE INVENTION

1. Field of the Invention

The present invention relates to a mobile communication device, and more particularly to a noise adaptive mobile communication device, and a call sound synthesizing method using the same in which a call sound can be identified despite noise from a peripheral environment when the call sound is received through the mobile communication device.

2. Description of the Related Art

A mobile communication device refers to a communication device for communicating with another party, for example, a cellular phone and a PDA (Personal Digital Assistant), etc. In the mobile communication device, to improve a call quality, noise generated externally or internally in addition to a call sound is reduced or even eliminated. Technology related to noise elimination employs physical noise-canceling.

However, noise generated in a peripheral environment of a receiver side is combined with the call sound outputted from the receiver side mobile communication device, which is received or heard by a receiver, e.g., through a receiver's ear when the receiver is a person Thus, a conventional mobile communication device has a drawback in that the receiver (person) receives a low quality call sound when exposed to noise generated in the peripheral environment . For example, when the peripheral environment is a subway station, a road or the like, the receiver cannot effectively identify the call sound transmitted from a sender due to the noise generated in the subway station or the road. When the receiver receives the call sound outputted from a speaker of the mobile communication device, the receiver cannot identify the call sound due to the interference of the noise, which is received and combined with the call sound.

In the conventional mobile communication device, a technique in which the noise is reduced or even eliminated at the mobile communication device of the receiver side is not available. Further, a technique with regard to a characteristic of a human ear is not available.

SUMMARY OF THE INVENTION

According to an aspect of the invention, there is provided a noise adaptive mobile communication device including a microphone to collect noise from a peripheral environment; a sensor which senses the collected noise; a frequency-component detecting unit which detects a frequency component of the sensed collected noise; a sound generating unit to generate a noise-adaptive sound from the detected frequency component; a call-sound synthesizing unit to synthesize received call sound with the noise-adaptive sound; and an operation control unit to control the call-sound synthesizing unit to operate at a predetermined time.

According to an aspect of the invention, the microphone is installed a predetermined distance from a speaker that outputs the received call sound.

According to an aspect of the invention, the unit senses the collected noise having a magnitude that is greater than a predetermined magnitude.

According to an aspect of the invention, the frequency-component detecting unit detects a main frequency component of the sensed noise that is a main source of the sensed noise.

According to an aspect of the invention, the sound generating unit reduces a magnitude of the main frequency component to generate the noise-adaptive sound.

According to an aspect of the invention, the call-sound synthesizing unit synthesizes the received call sound and the noise-adaptive sound when the received call sound is either a sender's voice or a text-to-speech sound.

According to an aspect of the invention, there is provided a frequency database to store sample frequency components according to noise patterns of peripheral environments.

According to an aspect of the invention, there is provided a look-up-table for the in the frequency database to store the sample frequency components constructed corresponding to the peripheral environments.

According to an aspect of the invention, there is provided a position tracing service to determine positional information of the collected noise.

According to an aspect of the invention, when the sensor does not sense the noise, the sound generating unit receives a sample frequency component corresponding to a peripheral environment understood by the position tracing service, from among the sample frequency components stored in the frequency database, to generate the noise-adaptive sound from the received sample frequency component.

According to an aspect of the invention, the operation control unit receives positional information via the position tracing service, and the operation control unit controls the frequency database to output the sample frequency component of the peripheral environment corresponding to the received positional information to the sound generating unit.

According to an aspect of the invention, the operation control unit increases the predetermined time for operating the call synthesizing unit in proportion to a call maintenance time.

According to another aspect of the invention, there is provided a call sound synthesizing method using a noise adaptive mobile communication device, the method including: collecting noise from a peripheral environment, determining whether a magnitude of the collected noise is greater than a predetermined magnitude, detecting a frequency component of the sensed noise when the collected noise is determined to be greater than the predetermined magnitude, generating a noise-adaptive sound from the detected frequency component, and synthesizing the generated noise-adaptive sound with a received call sound at a predetermined time.

According to an aspect of the invention, there is further provided a detecting of a main frequency component of the sensed noise, wherein the main frequency component of the sensed noise is a main source of the sensed noise.

According to an aspect of the invention, there is provided a reducing of the magnitude of a main frequency component of the sensed noise to generate the noise-adaptive sound.

According to an aspect of the invention, there is provided a synthesizing of the received call sound and the generated noise-adaptive sound, wherein the received call sound and the noise-adaptive sound are synthesized when the received call sound is either a sender's voice or a text-to-speech sound.

According to an aspect of the invention, the synthesizing of the received call sound and the generated noise-adaptive sound includes: synthesizing the received call sound with the generated noise-adaptive sound, sensing whether a call is in an on-state, and determining whether the predetermined time lapses when the call is in the on-state, wherein when the predetermined time lapses, the received call sound and the generated noise-adaptive sound are synthesized, and when the predetermined time does not lapse, it is determined whether the call is in the on state.

According to an aspect of the invention, there is provided determining whether the noise is generated in a peripheral environment corresponding to positional information of a position tracing service when the magnitude of the collected noise is not greater than the predetermined magnitude, and extracting a sample frequency component corresponding to the peripheral environment and generating the noise-adaptive sound from the detected frequency component when the peripheral environment generates the noise.

According to an aspect of the invention, the noise-adaptive sound is generated from the extracted sample frequency component.

According to an aspect of the invention, the predetermined time is increased proportionally with a call maintenance time.

According to another aspect of the invention, there is provided a noise-adaptive communication device that synthesizes environmental noise with a received call sound such that the received call sound is identifiable from the environmental noise, including: a sound generating unit to generate a noise-adaptive sound in response to a frequency component of the environmental noise, and a synthesizing unit to synthesize the generated noise-adaptive sound and the received call sound at a predetermined time corresponding to the received call sound and outputs a synthesized call sound through an output terminal of the noise-adaptive communication device.

According to an aspect of the invention, there is provided a controller to control the synthesizing unit to synthesize the received call sound with the generated noise-adaptive sound at a predetermined time to suppress recognition of the environmental noise.

According to an aspect of the invention, the controller controls the synthesizing unit to synthesize the received call sound with the generated noise-adaptive sound every about 70 milliseconds to suppress recognition of the environmental noise.

According to an aspect of the invention, the predetermined time is proportional to an amount of time of the call sound that is transmitted to the noise-adaptive communication device.

According to an aspect of the invention, the received call sound is either a senders' voice or a generated text-to-speech sound.

According to an aspect of the invention, the synthesizing unit receives the received call sound through an input terminal and the generated noise-adaptive sound from the sound generating unit, in response to a control signal inputted each predetermined time from the controller.

According to an aspect of the invention, the generated noise-adaptive sound corresponds to an analogous frequency component of the environmental noise that is inputted via a microphone on the noise-adaptive communication device.

According to an aspect of the invention, there is provided a frequency database to store sample frequency components according to noise patterns of the environmental noise such that when the noise-communication device is determined to be in a particular environment associated having an environmental noise pattern stored in the frequency database, the environmental noise pattern stored in the frequency database is received by the sound generating unit to generate the noise-adaptive sound.

According to an aspect of the invention, the sample frequency components stored in the frequency database relate to specific peripheral environments where the noise-adaptive communication device is used.

According to an aspect of the invention, there is provided a position tracing service to determine position information of the noise-adaptive communication device when the environmental noise is not sensed by the microphone, obtain a corresponding sample frequency component from the frequency database, and transmit the corresponding sample frequency component to the sound generating unit, wherein the sound generating unit receives the sample frequency component from the position tracing service and generates the noise-adaptive sound.

According to an aspect of the invention, there is provided a speaker to output the received call sound; and a microphone to receive the environmental noise, wherein the speaker and the microphone are provided anyplace on the noise-adaptive communication device.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
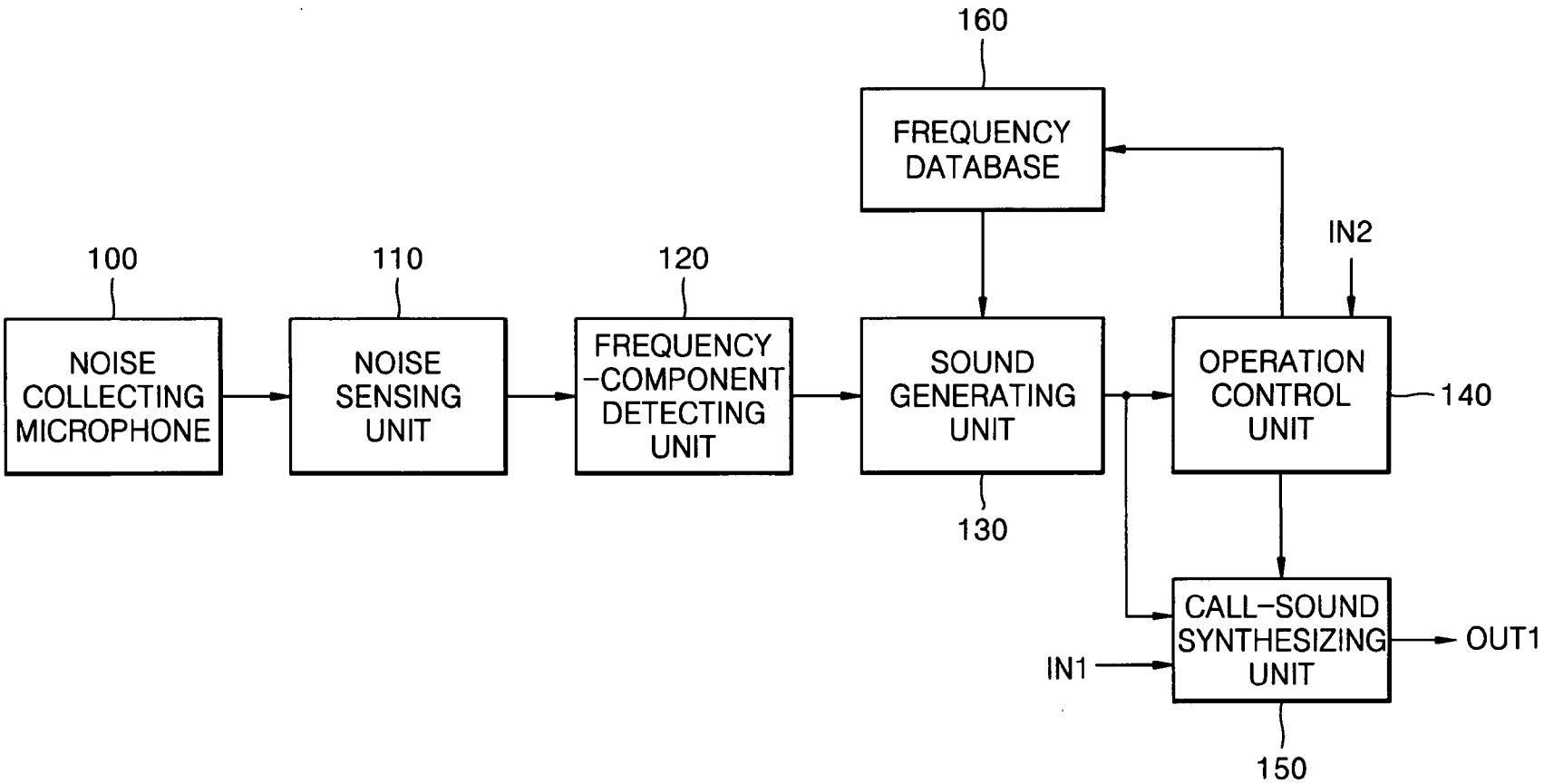
FIG. 1 is a block diagram illustrating a noise adaptive mobile communication device according to an embodiment of the invention.

Reference will now be made in detail to the embodiments of the present invention, examples of which are illustrated in the accompanying drawings, wherein like reference numerals refer to the like elements throughout. The embodiments are described below to explain the present invention by referring to the figures.

A precedence effect and an adaptation effect are two characteristics related to how a human ear hears sound.

The precedence effect refers to an effect in which the ear automatically suppresses the same signal inputted within several tens of milliseconds [ms] as a signal first inputted to the ear. For example, when one listens to sound in a closed space, such as a concert hall, he/she listens to a direct sound, and then listens to a reflection sound following the direct sound. The direct sound is incident on and reflected from a wall surface and the like of the closed space to become the reflection sound. The precedence effect refers to an effect in which when the ear receives all of the direct sound and the reflection sound, the ear is prevented from hearing or recognizing the reflection sound, thereby more clearly identifying the direct sound.

The adaptation effect refers to a nerve characteristic in which the hearing ability of a human ear is gradually decreased in sensitivity when the ear is continuously exposed to the same sound. Thus, when the ear continuously receives the same sound, the operation of the ear deteriorates as a function of receiving the sound. This effect is called an "adaptation effect."

FIG. 1 is a block diagram illustrating a noise adaptive mobile communication device according to an embodiment of the invention.

The noise adaptive mobile communication device includes a noise collecting microphone 100, a noise sensing unit 110, a frequency-component detecting unit 120, a sound generating unit 130, an operation control unit 140, a call-sound synthesizing unit 150, and a frequency database 160.

The noise collecting microphone 100 collects environmental noise. The noise collecting microphone 100 receives a sound wave or an ultrasonic wave to generate an electrical signal depending on the vibration of the sound wave or the ultrasonic wave.

The noise collecting microphone 100 is installed to be at a predetermined distance from a speaker 180 for outputting the received call sound. The speaker 180 is an output unit of the mobile communication device for outputting the call sound such that a receiver can receive the call sound through the ear. The noise collecting microphone 100 may be installed to be a predetermined distance from the speaker 180. The noise collecting microphone 100 is disposed in close proximity to the call sound outputted from the speaker such that the receiver can more exactly perceive or recognize a noisy degree through the ear.

Figure 2:
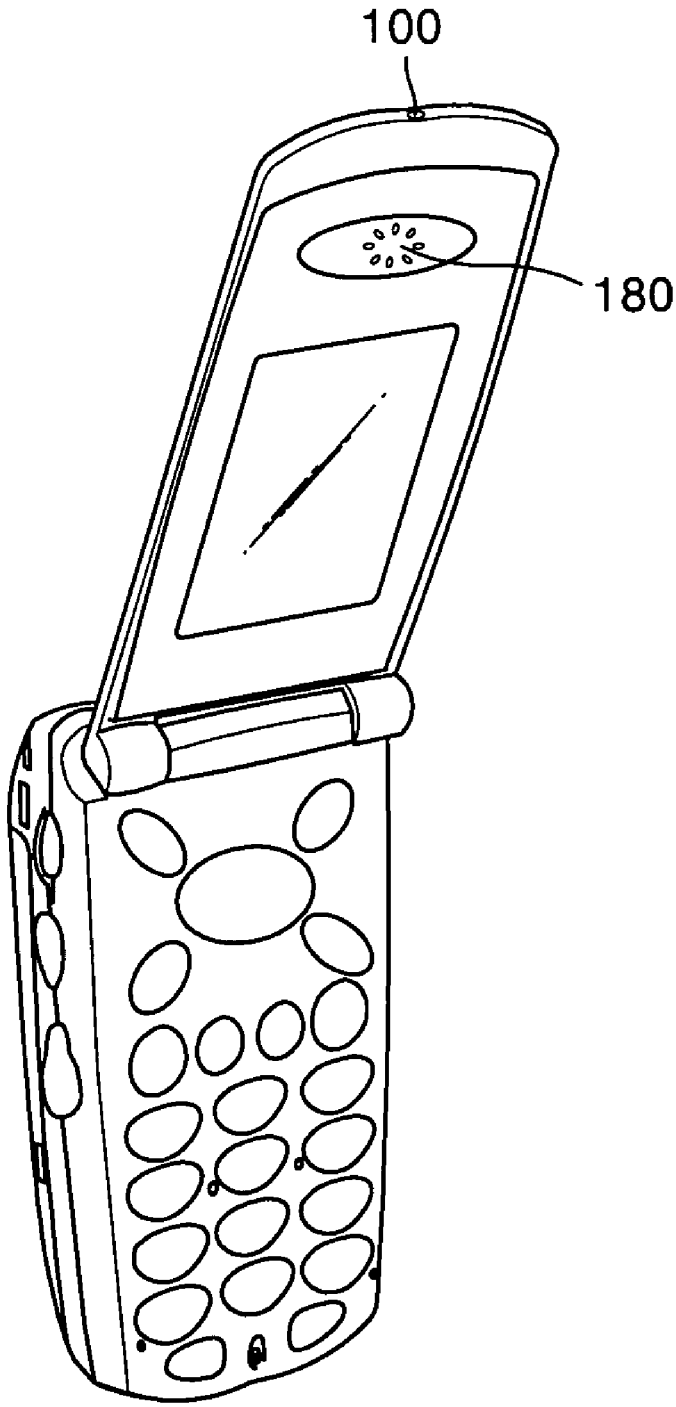
FIG. 2 is a mobile communication device having a speaker and a noise collecting microphone installed near the speaker.

FIG. 2 is a view illustrating an example of the mobile communication device having the speaker 180, and the noise collecting microphone 100 installed in close proximity to the speaker 180. However, the noise collecting microphone 100 shown in FIG. 2 may be installed at various positions adjacent to the speaker 180.

The noise collecting microphone 100 outputs the collected noise to the noise sensing unit 110.

The noise sensing unit 110 senses the collected noise, and outputs the sensed result as a noise-sense signal. The noise sensing unit 110 senses the collected noise having more than a predetermined magnitude. The noise sensing unit 110 does sense the collected noise having more than a predetermined decibel [dB], among the noises collected at the noise collecting microphone 100, and does not sense the collected noise having less than the predetermined decibel [dB]. The noise sensing unit 110 outputs the sensed noise-sense signal to the frequency-component detecting unit 120.

The frequency-component detecting unit 120 detects a frequency component of the sensed noise in response to the noise-sense signal, and outputs the detected result as a frequency-detection signal. When the frequency-component detecting unit 120 receives the noise-sense signal from the noise sensing unit 110, the frequency component detecting unit 120 detects a main frequency component of the sensed noise.

The sensed noise includes a plurality of frequency components. The frequency-component detecting unit 120 can detect each of the plurality of frequency components, and may detect the main frequency components that function as main causes or sources of the noise. The frequency-component detecting unit 120 outputs the detected result as a frequency-detection signal to the sound generating unit 130.

The sound generating unit 130 generates a noise-adaptive sound from the detected frequency component in response to the frequency-detection signal, and outputs the generated noise-adaptive sound as a sound-generation signal. The sound generating unit 130 generates the noise-adaptive sound corresponding to an analogous component from the detected frequency component in response to the frequency-detection signal inputted from the frequency-component detecting unit 120.

The noise-adaptive sound refers to sound that is combined or synthesized with the call sound to obtain the above-described precedence effect. For example, the noise-adaptive sound refers to the sound that is processed to combine the noise, which is inputted to the noise collecting microphone 100, with the call sound. The noise-adaptive sound has a length of less than several tens of milliseconds [ms]. According to an embodiment of the invention, the noise adaptive sound has a length of 40 to 50 milliseconds [ms].

The sound generating unit 130 may reduce the magnitude of the main frequency components inputted from the frequency-component detecting unit 120 to generate the noise-adaptive sound. The main frequency components are reduced in magnitude to prevent the noise-adaptive sound from functioning as the noise when the noise-adaptive sound is synthesized with the call sound.

The sound generating unit 130 outputs the generated noise-adaptive sound to the operation control unit 140 and the call-sound synthesizing unit 150 as the sound-generation signal.

The operation control unit 140 controls the call-sound synthesizing unit 150 to operate each predetermined time in response to the sound-generation signal. The operation control unit 140 controls the operation of the call-sound synthesizing unit 150 in response to the sound-generation signal, which is inputted from the sound generation unit 130. The operation control unit 140 controls the call-sound synthesizing unit 150 to operate approximately every 70 milliseconds [ms] to suppress the recognition function of the ear against the noise. For example, the operation control unit 140 controls the generation of the call sound, which is synthesized every 70 milliseconds [ms] at the call-sound synthesizing unit 150. In order to suppress the sound recognition of the ear due to the precedence effect, the call sound is synthesized and generated every about 70 milliseconds [ms].

The ear receives the noise-adaptive sound, which is a factor of the synthesized call sound, thereby providing an effect in which the noise subsequently received by the ear is suppressed. The call sound is synthesized and generated every 70 milliseconds [ms], and received through the ear. Accordingly, the ear can more appropriately identify a sender's voice or a physical (mechanical) sound using a text-to-speech function, from the synthesized call sound rather than from an original call sound. However, the time of 70 milliseconds [ms] is provided as one example, and can be increased or decreased according to need.

The operation control unit 140 then increases a predetermined time in proportion to a call time, e.g., call maintenance time. When the ear continues to receive a similar magnitude of noise according to the lengthening of the call maintenance time, the recognition function of the ear is gradually decreased. This is because the ear has the above adaptation effect. Accordingly, when the call maintenance time is increased, it does not matter that a period of an operation time is increased without need of controlling to operate the call-sound synthesizing unit 150 about every 70 milliseconds

[ms]. By doing so, generation times of the synthesized call sound are reduced while the call sound can be also effectively received against the noise.

The call-sound synthesizing unit 150 synthesizes the received call sound and the noise-adaptive sound. The call-sound synthesizing unit 150 synthesizes the call sound received through an input terminal IN1 with the noise-adaptive sound inputted from the sound generating unit 130, in response to a control signal inputted each predetermined time from the operation control unit 140. Further, the call-sound synthesizing unit 150 synthesizes the call sound with the noise-adaptive sound, in response to the control signal, which is inputted each predetermined increased time from the operation control unit 140.

The call-sound synthesizing unit 150 synthesizes the received call sound and the noise-adaptive sound when the received call sound corresponds to any one of the sender's voice and the physical sound using the text-to-speech function. The text-to-speech function refers to a voice synthesizing technology for converting character information into voice information. For example, the call-sound synthesizing unit 150 can also synthesize and output the sender's voice and the noise-adaptive sound, and can synthesize and output the physical sound using the text-to-speech function and the noise-adaptive sound.

When the ear receives the call sound synthesized at the call-sound synthesizing unit 150, the ear deteriorates as a function of identifying the noise, which is subsequently received, due to the precedence effect caused by the noise-adaptive sound. Accordingly, the ear receives the synthesized call sound rather than the original call sound, thereby more appropriately identifying the received call sound.

The call-sound synthesizing unit 150 outputs the synthesized call sound through an output terminal OUT1.

The frequency database 160 stores sample frequency components according to a pattern of the environmental noise. For example, the frequency database 160 stores meta data such as a sample frequency component corresponding to a pattern of the noise generated at the subway station, a sample frequency component corresponding to a pattern of the noise generated at a roadside, and a sample frequency component corresponding to a pattern of the noise generated in a shopping area, etc.

The frequency database 160 constructs and stores the sample frequency components corresponding to peripheral environments in the Look-Up Table (LUT). Table 1 an one example of the LUT.

TABLE 1

| Peripheral Environment | Sample frequency component |
|---|---|
| Subway Station | First sample frequency component |
| Road | Second sample frequency component |
| Shopping Area | Third sample frequency component |
| Construction Site | Fourth sample frequency component |

As shown in Table 1, the sample frequency components depending on the peripheral environment are previously prepared.

The operation control unit 140 receives positional information by using a position tracing service, and controls the frequency database 160 to output the sample frequency component of the peripheral environment corresponding to the received positional information to the sound generating unit 130. When the operation control unit 140 receives positional information by using the position tracing service through an input terminal IN2, the operation control unit 140 senses where the peripheral environment corresponding to the received positional information is located.

The operation control unit 140 can identify that the sensed peripheral environment is a location in which noise is generated. When the operation control unit 140 identifies that the sensed peripheral environment is a location in which noise is generated, the operator control unit 140 outputs a control signal to the frequency database 160 such that the frequency database 160 outputs the sample frequency component corresponding to the sensed peripheral environment to the sound generating unit 130. For example, according to Table 1, when the operation control unit 140 senses that the peripheral environment is "subway station" from the positional information, outputs the control signal to the frequency database 160, such that the frequency database 160 outputs "first sample frequency component" corresponding to "subway station."

By the control signal of the operation control unit 140, the sample frequency component corresponding to the peripheral environment from among the sample frequency components of the frequency database 160, is outputted to the sound generating unit 130.

When the noise sensing unit 110 does not sense the noise, the sound generating unit 130 receives the sample frequency component corresponding to the peripheral environment, which is understood or readable by the position tracing service, from among the sample frequency components stored in the frequency database 160, to generate the noise-adaptive sound from the received sample frequency component. For example, when the sound generating unit 130 receives "first sample frequency component" from the frequency database 160, the sound generating unit 130 generates the noise-adaptive sound from "first sample frequency component", and outputs the generated noise-adaptive sound to the operation control unit 140 and the call-sound synthesizing unit 150.

FIGS. 3A through 3E are views illustrating embodiments the noise adaptive mobile communication device shown in FIG. 1.

Figure 3A:
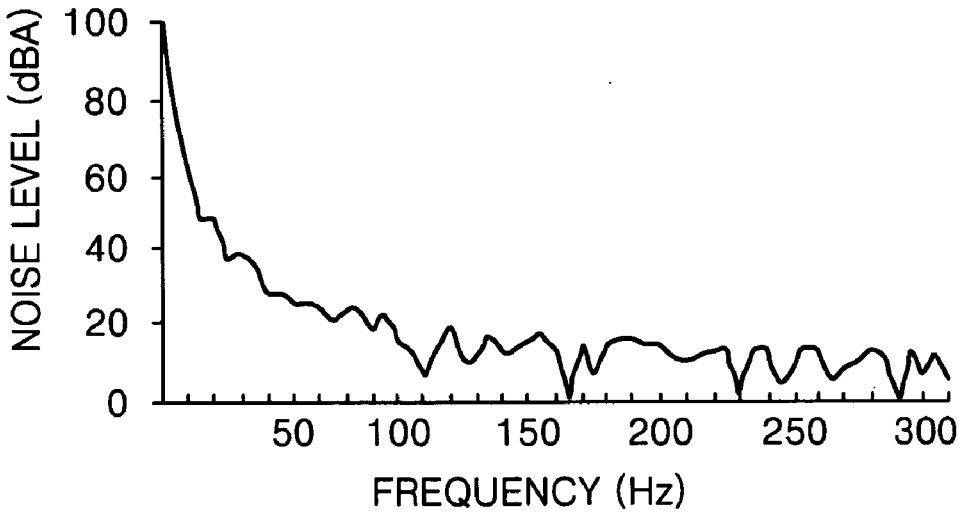
FIGS. 3A through 3E are views illustrating a noise adaptive mobile communication device shown in FIG. 1.
Figure 3B:
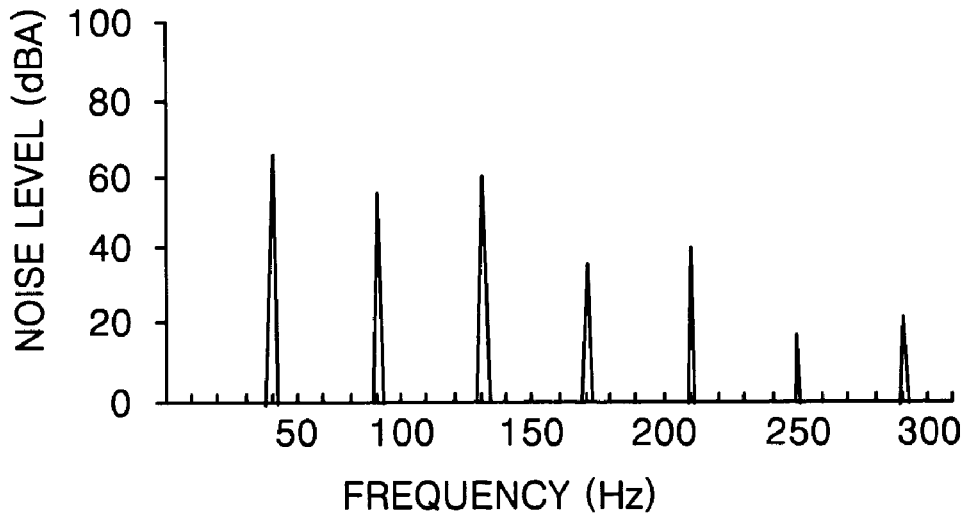
Figure 3C:
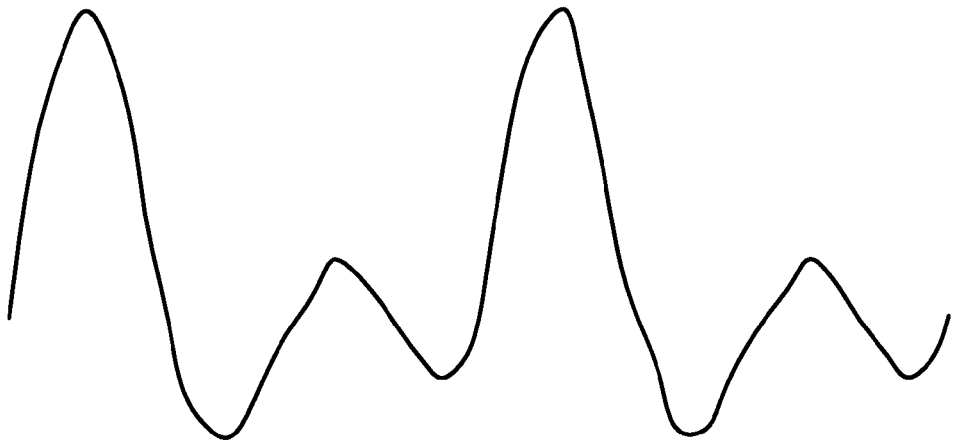

FIG. 3A illustrates an example of the noise collected by the noise collecting microphone 100. FIG. 3B illustrates an example of the main frequency component of the noise detected by the frequency-component detecting unit 120. FIG. 3C illustrates an example of the analogous noise-adaptive sound generated at the sound generating unit 130 for the main frequency component detected in FIG. 3B.

Figure 3D:
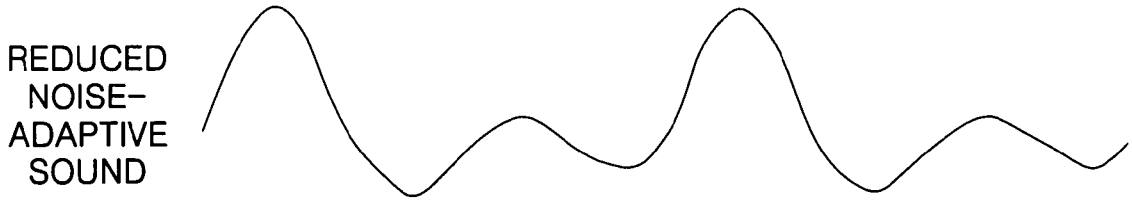

FIG. 3D illustrates an example of the magnitude-reduced noise-adaptive sound shown in FIG. 3C.

Figure 3E:
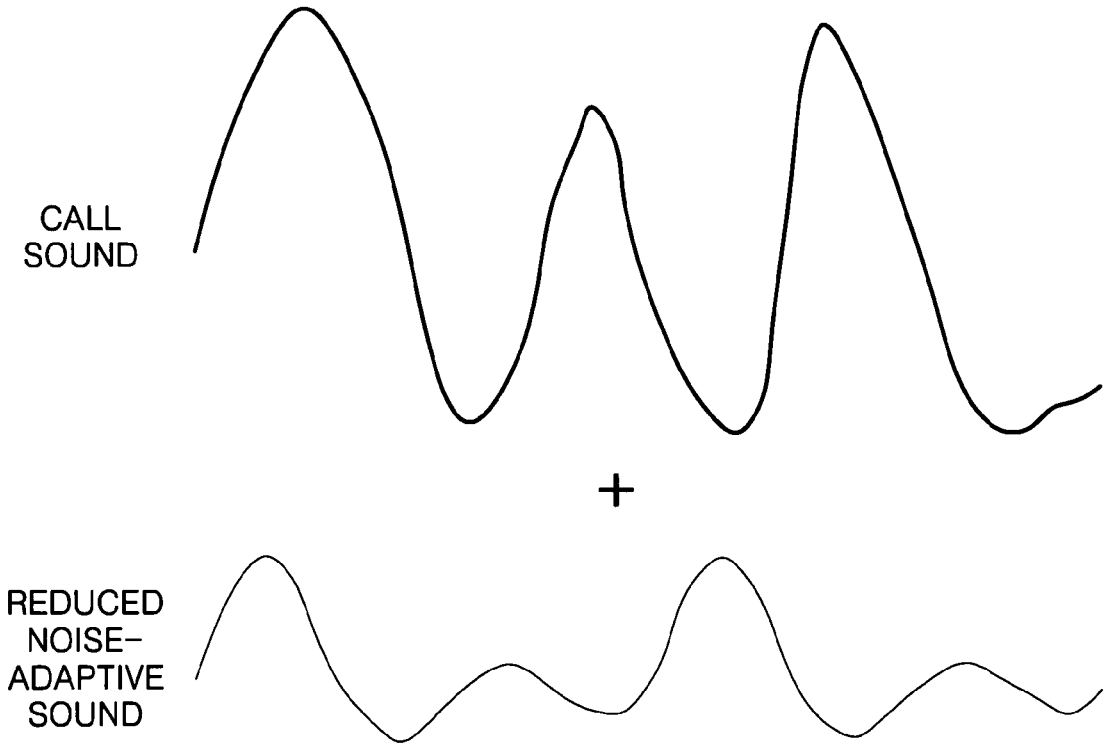

FIG. 3E illustrates an example of the synthesizing of the call sound with the magnitude-reduced noise-adaptive sound shown in FIG. 3D.

By synthesizing and receiving the noise-adaptive sound and the original call sound and receiving the synthesized sand through the ear, the receiver can more easily receive or understand the call sound due to the reduction of the recognition capability against the noise, which is subsequently received.

Hereinafter, a call sound synthesizing method using the noise adaptive mobile communication device according to an embodiment of the invention is described with reference to the attached drawings.

Figure 4:
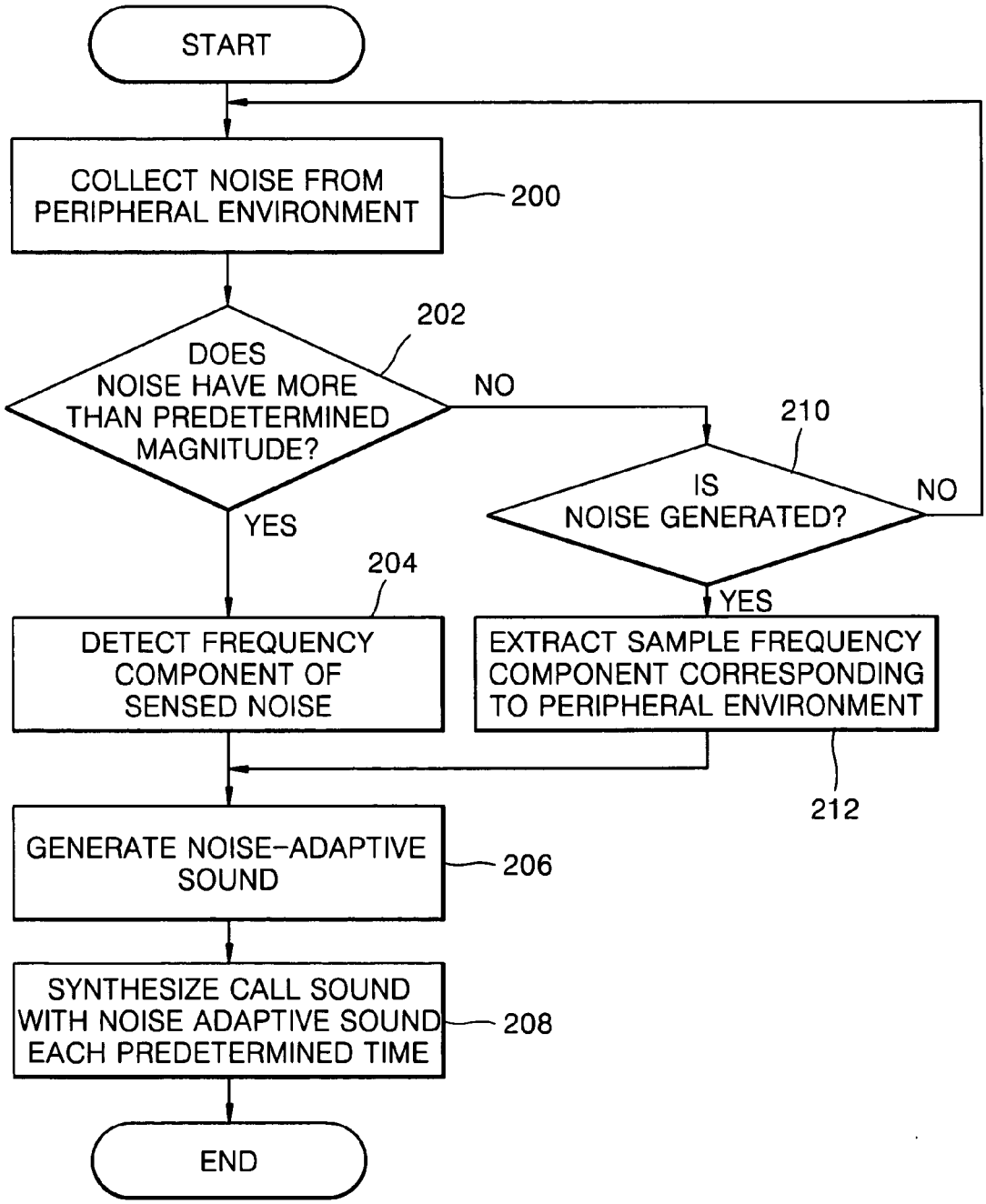
FIG. 4 is a flowchart illustrating a call sound synthesizing method using a noise adaptive mobile communication device according to an embodiment of the invention.

FIG. 4 is a flowchart illustrating the call sound synthesizing method using the noise adaptive mobile communication device according to an embodiment of the invention. FIG. 4 includes the generating of the noise-adaptive sound from the frequency component of the noise, and the synthesizing of the generated noise-adaptive sound with the call sound (S200 to S212).

The noise of the peripheral environment is collected in operation 200.

Upon collecting the noise of the perpetual environment, it is sensed whether the collected noise has more than a predetermined magnitude in operation 202. It may also sensed whether the noise is inputted with more than a predetermined decibel.

When the collected noise has a greater magnitude than the predetermined magnitude, the frequency component of the sensed noise is detected in operation 204. At this time, the main frequency component of the sensed noise is detected.

In operation 206, the noise-adaptive sound is generated from the detected frequency component. A magnitude of the detected main frequency component is reduced to generate the noise-adaptive sound.

In operation 208, the received call sound and the generated noise-adaptive sound are synthesized each predetermined time. The predetermined time is increased in proportion to the call maintenance time. Further, when the received call sound is the sender's voice, the sender's voice is synthesized with the noise-adaptive sound. When the received call sound is the physical sound using the text-to-speech function, the physical sound using the text-to-speech function is synthesized with the noise-adaptive sound.

Figure 5:
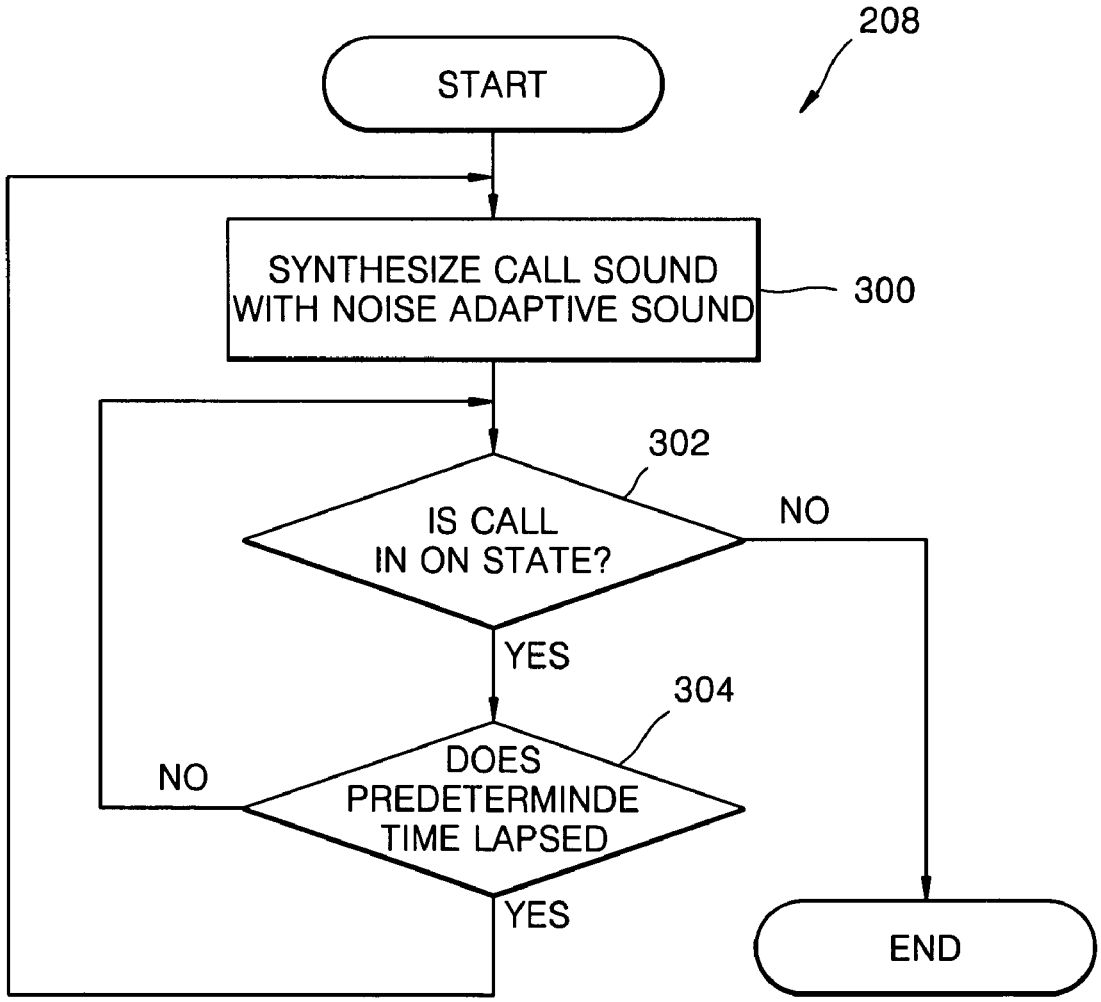
FIG. 5 is a flowchart illustrating the synthesizing of a call sound with noise-adaptive sound in a call sound synthesizing method using a noise adaptive mobile communication device shown in FIG. 4.

FIG. 5 is a flowchart illustrating operation 208, e.g., the synthesizing of the call sound and the noise-adaptive sound (S208) in the call sound synthesizing method using the noise adaptive mobile communication device shown in FIG. 4. FIG. 5 includes the synthesizing of the call sound and the noise-adaptive sound depending on whether the call is in an on state.

In operation 300, the received call sound is synthesized with the generated noise-adaptive sound (S300).

In operation 302, it is sensed whether the call is in the on state. The call-state detecting unit (not shown) of the mobile communication device provides information on whether the call is in the on state when the receiver continues the call with the sender..

When the call is in an off state, the above processes are terminated.

However, when the call is in the on state, it is sensed whether a predetermined time lapses in operation 304. Here, it is appropriate that the predetermined time is about 70 milliseconds [ms] so as to obtain the precedence effect.

When the predetermined time lapses, operation 300, e.g., the synthesizing of the received call sound and the generated noise-adaptive sound, and operation 302, e.g., the sensing of whether the call is in the on state, are repeated because the call sound should be again synthesized with the noise-adaptive sound.

However, when the predetermined time does not lapse, the sensing of whether the call is in the on state is repeated since it is not the time when the call sound should be synthesized with the noise-adaptive sound.

When the collected noise does not have more than the predetermined magnitude (operation 202) in FIG. 4, in operation 210 it is determined whether the noise is generated in the peripheral environment corresponding to the positional information, which is obtained by the position tracing service. It is determined whether the peripheral environment is a location in which the noise is generated even though the noise is not currently generated in the peripheral environment at which the mobile communication device is installed.

When the peripheral environment does not generate the noise, the collecting of the peripheral noise (operation 200) and the sensing of whether the collected noise has more than the predetermined magnitude (operation 202) are performed.

However, when the peripheral environment generates the noise in operation 212, the sample frequency component corresponding to the peripheral environment is extracted and the noise-adaptive sound (operation 206) is generated. When the peripheral environment generates the noise even though the peripheral environment does not currently generate the noise, the sample frequency component corresponding to the peripheral environment is extracted.

In operation 206, the noise-adaptive sound is generated from the extracted sample frequency component in operation 212. The generated noise-adaptive sound is then synthesized with the call sound in operation 208.

As described above, the noise adaptive mobile communication device and the call sound synthesizing method using the noise adaptive mobile communication device according to at least the above discussed embodiments the invention improve the user's ability to identify the call sound against the noise, which is unexpectedly generated at the time of using the mobile communication device, is improved using the precedence effect and the adaptation effect that are the characteristics of the ear.

Further, each of the above-described embodiments of the invention has an effect in that with regard to user's current peripheral environment, the user's ability to identify the call sound is improved.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A noise adaptive mobile communication device comprising:

a microphone to collect noise from a peripheral environment;

a sensor which senses the collected noise;

a frequency-component detecting unit which detects a frequency component of the sensed collected noise;

a sound generating unit to generate a noise-adaptive sound from the detected frequency component;

a call-sound synthesizing unit to synthesize received call sound with the noise-adaptive sound;

an operation control unit to control the call-sound synthesizing unit to operate at a predetermined time, to receive positional information of the mobile communication device by using a position tracing service, to identify a peripheral environment in which noise is generated, and to output a sample frequency component corresponding to the identified peripheral environment to the sound generating unit; and a frequency database to store sample frequency components corresponding to noise patterns of peripheral environments, wherein the sound generating unit receives the sample frequency component which is determined from among the sample frequency components stored in the frequency database, to generate the noise-adaptive sound from the received sample frequency component.

2. The noise adaptive mobile communication device of claim 1, wherein the microphone is installed a predetermined distance from a speaker that outputs the received call sound.

3. The noise adaptive mobile communication device of claim 1, wherein the unit senses the collected noise having a magnitude that is greater than a predetermined magnitude.

4. The noise adaptive mobile communication device of claim 1, wherein the frequency-component detecting unit detects a main frequency component of the sensed noise that is a main source of the sensed noise.

5. The noise adaptive mobile communication device of claim 4, wherein the sound generating unit reduces a magnitude of the main frequency component to generate the noise-adaptive sound.

6. The noise adaptive mobile communication device of claim 1, wherein the call-sound synthesizing unit synthesizes the received call sound and the noise-adaptive sound when the received call sound is either a sender's voice or a text-to-speech sound.

7. The noise adaptive mobile communication device of claim 1, further comprising:

a look-up-table for the frequency database to store the sample frequency components constructed corresponding to the peripheral environments.

8. The noise adaptive mobile communication device of claim 1, wherein the operation control unit receives positional information via the position tracing service, and the operation control unit controls the frequency database to output the sample frequency component of the peripheral environment corresponding to the received positional information to the sound generating unit.

9. The noise adaptive mobile communication device of claim 1, wherein the operation control unit increases the predetermined time for operating the call synthesizing unit in proportion to a call maintenance time.

10. A noise-adaptive communication device that synthesizes environmental noise with a received call sound such that the received call sound is identifiable from the environmental noise, comprising:

a sound generating unit to generate a noise-adaptive sound in response to a frequency component of the environmental noise, wherein the generated noise-adaptive sound corresponds to an analogous frequency component of the environmental noise that is inputted via a microphone on the noise-adaptive communication device;

a synthesizing unit to synthesize the generated noise-adaptive sound and the received call sound at a predetermined time corresponding to the received call sound and outputs a synthesized call sound through an output terminal of the noise-adaptive communication device; and a frequency database to store sample frequency components corresponding to noise patterns of the environmental noise such that when the noise-communication device is determined to be in a particular environment associated having an environmental noise pattern stored in the frequency database, the environmental noise pattern stored in the frequency database is received by the sound generating unit to generate the noise-adaptive sound, wherein the sound generating unit receives a sample frequency component which is determined from among the sample frequency components stored in the frequency database corresponding to a peripheral environment in which noise is generated, to generate the noise-adaptive sound from the received sample frequency component, and the peripheral environment is identified from positional information of the mobile communication device by using a position tracing service.

11. The noise-adaptive communication device of claim 10, further comprising:

a controller to control the synthesizing unit to synthesize the received call sound with the generated noise-adaptive sound at a predetermined time to suppress recognition of the environmental noise.

12. The noise-adaptive communication device of claim 11, wherein the controller controls the synthesizing unit to synthesize the received call sound with the generated noise-adaptive sound every about 70 milliseconds to suppress recognition of the environmental noise.

13. The noise-adaptive communication device of claim 11, wherein the predetermined time is proportional to an amount of time of the call sound that is transmitted to the noise-adaptive communication device.

14. The noise-adaptive communication device of claim 11, wherein the synthesizing unit receives the received call sound through an input terminal and the generated noise-adaptive sound from the sound generating unit, in response to a control signal inputted each predetermined time from the controller.

15. The noise-adaptive communication device of claim 10, wherein the received call sound is either a senders' voice or a generated text-to-speech sound.

16. The noise-adaptive communication device of claim 10, wherein the sample frequency components stored in the frequency database relate to specific peripheral environments where the noise-adaptive communication device is used.

17. The noise-adaptive communication device of claim 10, further comprising:

a speaker to output the received call sound; and a microphone to receive the environmental noise, wherein the speaker and the microphone are provided anyplace on the noise-adaptive communication device.

* * * * *